US008904927B1

(12) United States Patent
Pendleton et al.

(10) Patent No.: US 8,904,927 B1
(45) **Date of Patent: *Dec. 9, 2014**

(54) PNEUMATIC CONTAINER COMPACTING APPARATUS

(76) Inventors: Lillian C. Pendleton, Poland, IN (US); Mark J. Pendleton, Poland, IN (US)

( * ) Notice: Subject to any disclaimer, the term of this patent is extended or adjusted under 35 U.S.C. 154(b) by 442 days.

This patent is subject to a terminal disclaimer.

(21) Appl. No.: 13/354,642

(22) Filed: Jan. 20, 2012

Related U.S. Application Data

(63) Continuation-in-part of application No. 12/487,521, filed on Jun. 18, 2009, now Pat. No. 8,122,824.

(51) Int. Cl.
*B30B 1/38* (2006.01)
*B30B 9/32* (2006.01)

(52) U.S. Cl.
USPC ..... 100/269.01; 100/245; 100/345; 100/347; 100/902

(58) Field of Classification Search
CPC ..... B30B 1/38; B30B 9/3007; B30B 9/3032; B30B 9/3057; B30B 9/321
USPC ..... 100/48, 347, 215, 219, 226, 240, 245, 100/169.01, 269.05, 269.14, 269.18, 902, 100/345, 269.01; 241/99
See application file for complete search history.

(56) References Cited

U.S. PATENT DOCUMENTS

| | | | | |
|---|---|---|---|---|
| 2,078,587 | A | | 4/1937 | Sadenwater |
| 2,817,290 | A | | 12/1957 | Parker et al. |
| 2,904,097 | A | * | 9/1959 | Cohen ..... 100/345 |
| 2,916,985 | A | | 12/1959 | Beach |
| 3,104,607 | A | * | 9/1963 | Galas ..... 100/345 |
| 3,354,693 | A | * | 11/1967 | Asari ..... 72/453.18 |
| D286,643 | S | | 11/1986 | Carney et al. |
| 5,060,564 | A | | 10/1991 | Buford et al. |
| 5,109,763 | A | | 5/1992 | Morris et al. |
| 5,174,199 | A | | 12/1992 | King et al. |
| 5,257,576 | A | | 11/1993 | Pearce et al. |
| 5,279,215 | A | | 1/1994 | Harder |
| 5,303,643 | A | | 4/1994 | Fisher et al. |
| D360,212 | S | | 7/1995 | Zanini |
| 5,624,018 | A | | 4/1997 | Schuff et al. |
| 5,678,478 | A | | 10/1997 | Goyal et al. |

* cited by examiner

*Primary Examiner* — Jimmy T Nguyen

(57) ABSTRACT

A pneumatic can crusher for compressing a metal can has a hollow pipe. A piston assembly is located inside the pipe with a head attached to a first end of a connecting rod and a bottom air cylinder connected to a second end of a connecting rod. In some embodiments, an opening is located in the pipe near the top end, for allowing the metal can to be inserted into the inside of the pipe and placed on a top surface of the head of the piston assembly. The pneumatic can crusher has a manually activated safety interlock operated by a foot of a user. Air from the air compressor pushes the air cylinder upward toward the top end of the pipe so to crush the metal can on the top surface of the head of the piston assembly.

17 Claims, 10 Drawing Sheets

PNEUMATIC CONTAINER COMPACTING APPARATUS

CROSS REFERENCE

This application claims priority to U.S. non-provisional application Ser. No. 12/487,521 filed Jun. 18, 2009, now U.S. Pat. No. 8,122,824, as a continuation-in-part, the specification of which is incorporated herein by reference in its entirety.

BACKGROUND OF THE INVENTION

Uncompacted debris including metal cans and plastic bottles occupies a considerable amount of space upon being discarded, making it cumbersome to store or transport. Thus, it is desirable to flatten or compact certain articles of debris having a large void area before storing or transporting so that more debris can be placed in a given space. Furthermore, crushing metal cans presents the material in a form in which is more readily handled for reuse and recycling.

SUMMARY

The present invention features a pneumatic can crusher for compressing a metal can or a plastic bottle. In some embodiments, the pneumatic can crusher has a hollow pipe having a top end, a bottom end, an outside, and an inside. In some embodiments, the top end of the pipe is closed and the bottom end is attached to a stand.

In some embodiments, a piston assembly is located inside the pipe near the bottom end. In some embodiments, the piston assembly has a head attached to a first end of a connecting rod and a bottom air cylinder connected to a second end of a connecting rod. In some embodiments, the piston assembly is oriented such that the head faces the top end of the pipe and the bottom air cylinder faces the bottom end of the pipe. In some embodiments, the bottom air cylinder is inside an inner cavity.

In some embodiments, an opening is located in the pipe near the top end, where the opening is for allowing the metal can to be inserted into the inside of the pipe and placed on a top surface of the head of the piston assembly. In some embodiments, a safety door for covering the opening in the pipe is pivotally attached to the pipe via a hinge mechanism. In some embodiments, the safety door is movable between an open and a closed position respectively allowing and preventing access to the inside of the pipe via the opening.

In some embodiments, an air compressor is connected to an air tank, where air from the air compressor is directed to a safety valve via a first hose. In some embodiments, the safety valve is movable between an open and a closed position respectively allowing and preventing compressed air to be delivered from the air compressor to the piston assembly via a second hose.

In some embodiments, the pneumatic can crusher has a manually activated safety interlock, where the safety interlock is biased to be engaged and can be disengaged by a foot of a user. In some embodiments, the safety interlock has a lever and a lever-activated hard stop located on the pipe. In some embodiments, the hard stop projects into the inside of the pipe providing a barrier between the head of the piston assembly and the top end of the pipe. In some embodiments, the safety interlock prevents upward movement of the piston assembly unless disengaged by the user.

In some embodiments, air from the air compressor pushes the air cylinder upward toward the top end of the pipe so to crush the metal can on the top surface of the head of the piston assembly.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

DESCRIPTION OF PREFERRED EMBODIMENTS

Figure 1:
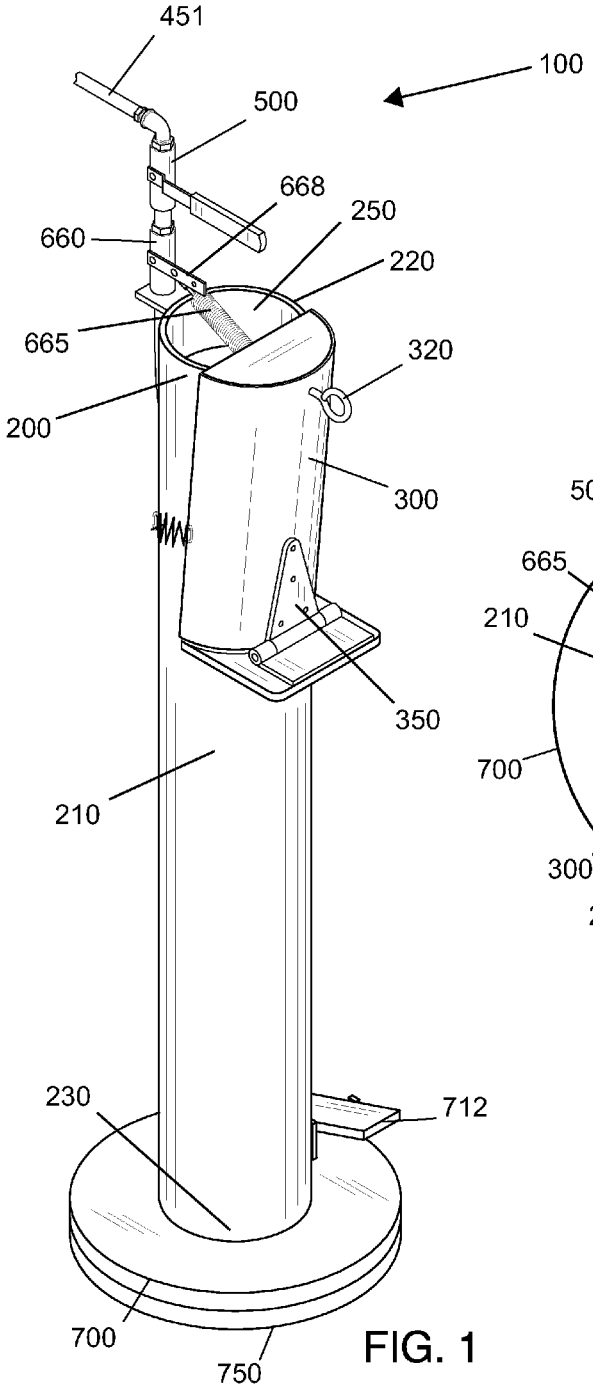
FIG. 1 is a perspective view of the present invention.

Following is a list of elements corresponding to a particular element referred to herein:

100 Pneumatic can crushing apparatus
150 Can
160 Bottle
200 Pipe
210 Outside surface of pipe
220 Top end of pipe
230 Bottom end of pipe
250 Inside of pipe
255 Opening
270 Piston assembly
280 Head of piston assembly
285 Top surface of head
286 Bottom surface of head
290 Connecting rod
295 First end of a connecting rod
296 Second end of a connecting rod
300 Safety door
320 Handle
350 Hinge mechanism
451 First hose
452 Second hose
453 Third hose
460 Venting orifice
470 Second hose fitting
480 Air exhaust valve
500 Trip lever
550 Adjustable pop-off valve
650 Pressure gauge
660 Safety valve
665 Spring

Figure 2:
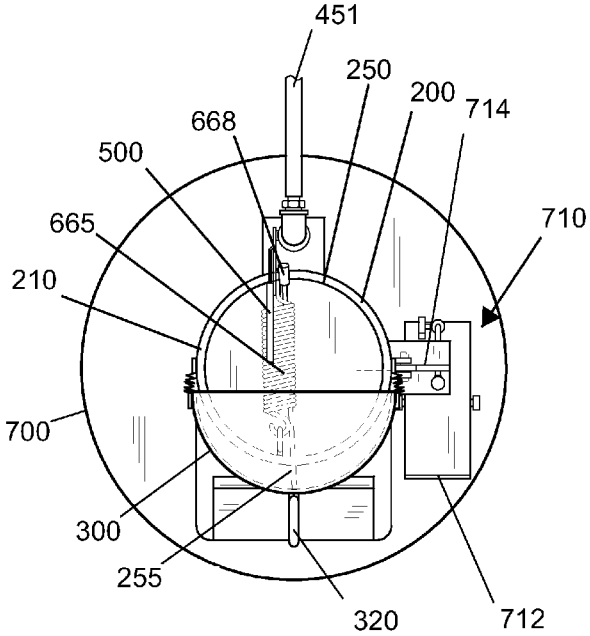
FIG. 2 is a top view of the present invention.
Figure 3:
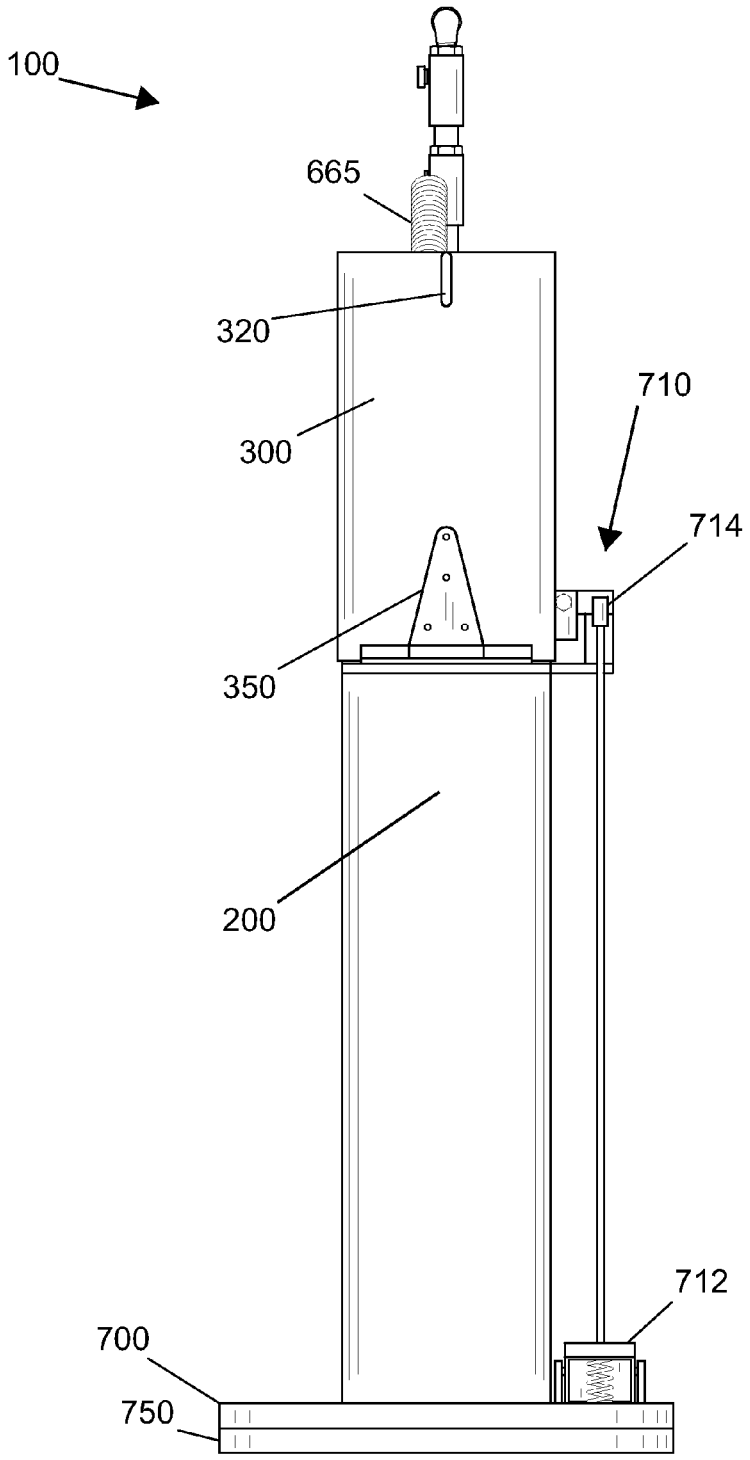
FIG. 3 is a front view of the present invention.
Figure 4A:
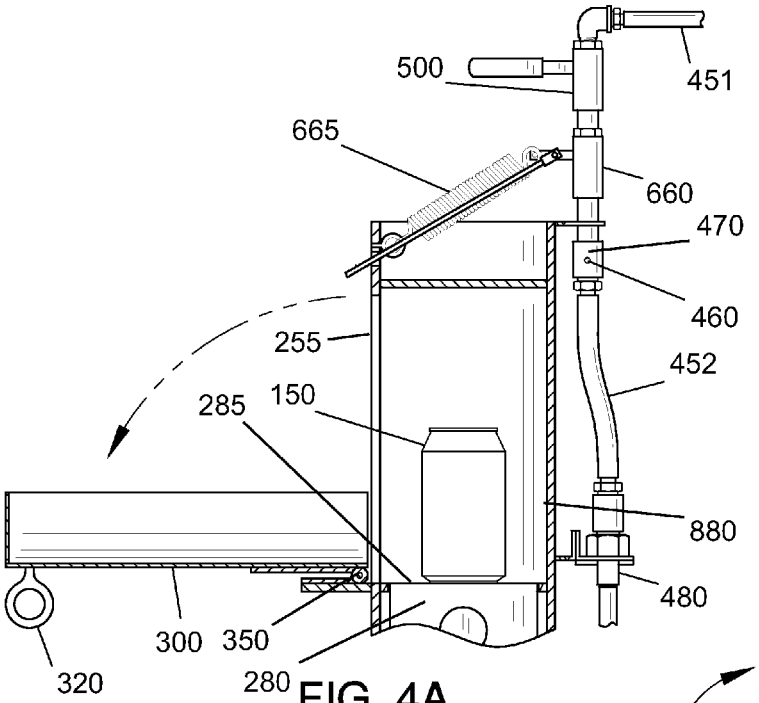
FIG. 4A is a side view of the piston assembly (compacting assembly) of the present invention.
Figure 4B:
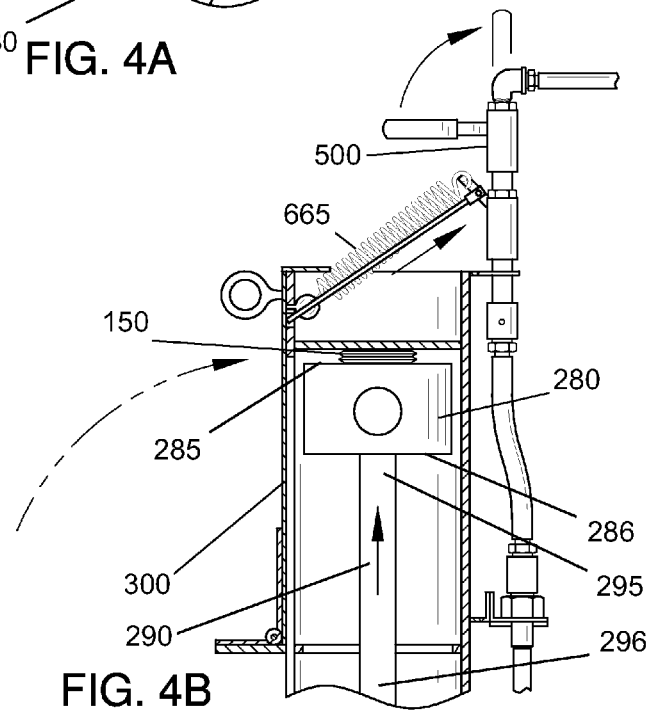
FIG. 4B is a side view of the piston assembly (compacting assembly) of the present invention.
Figure 5:
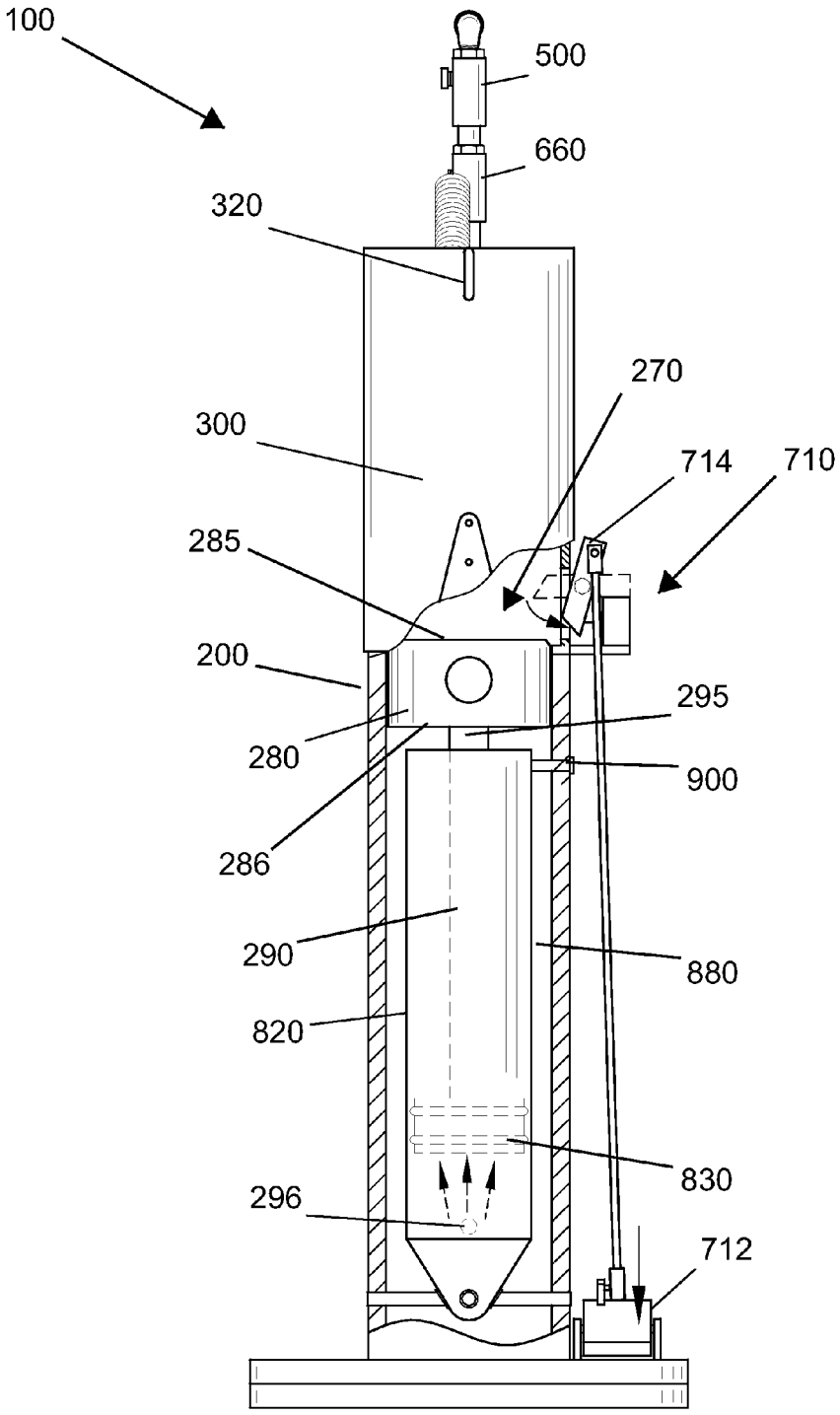
FIG. 5 is a cutaway view of the present invention.
Figure 6:
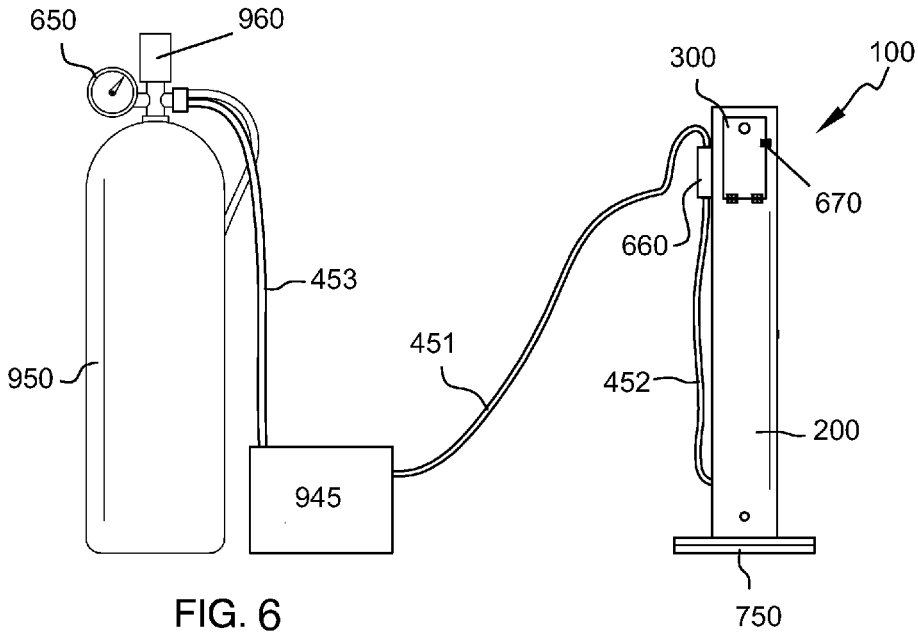
FIG. 6 is a front view of the present invention.
Figure 7:
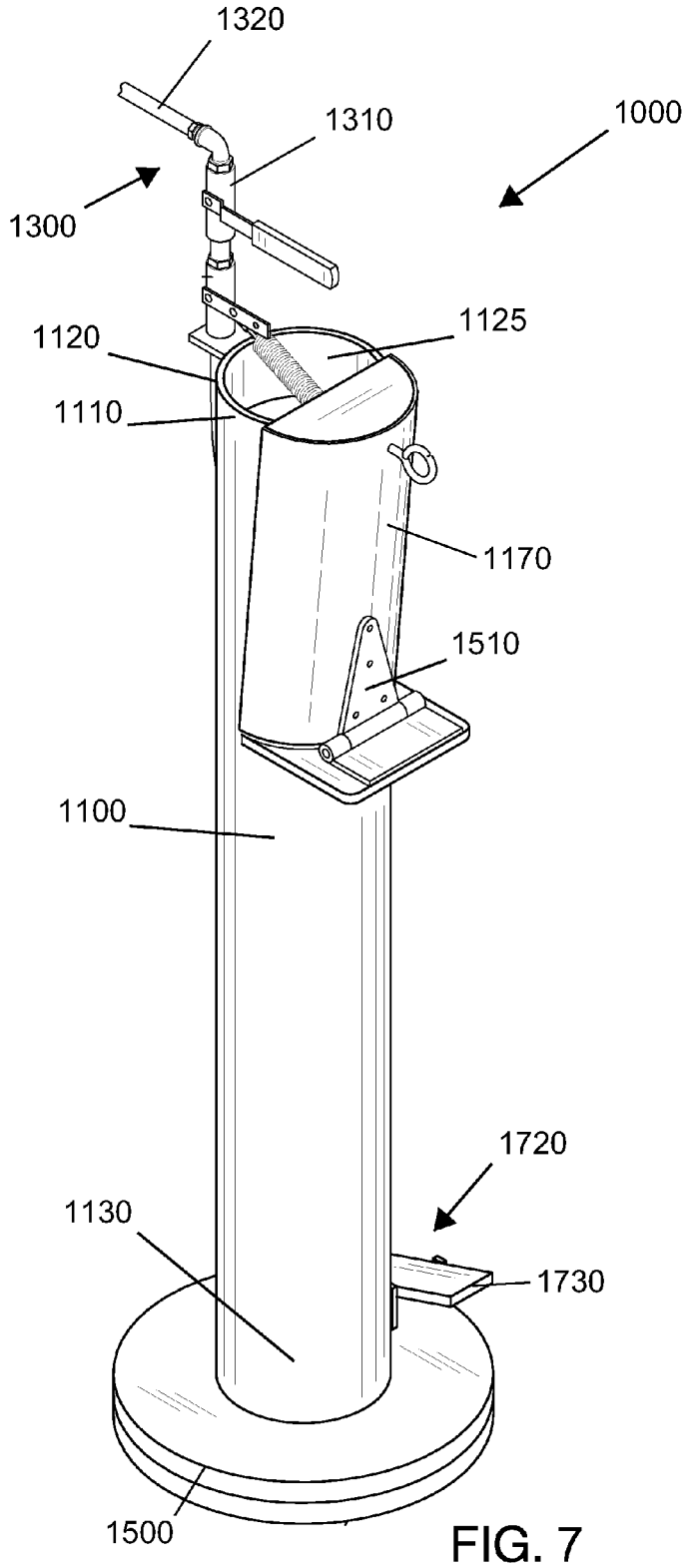
FIG. 7 is a perspective view of the present invention.
Figure 8:
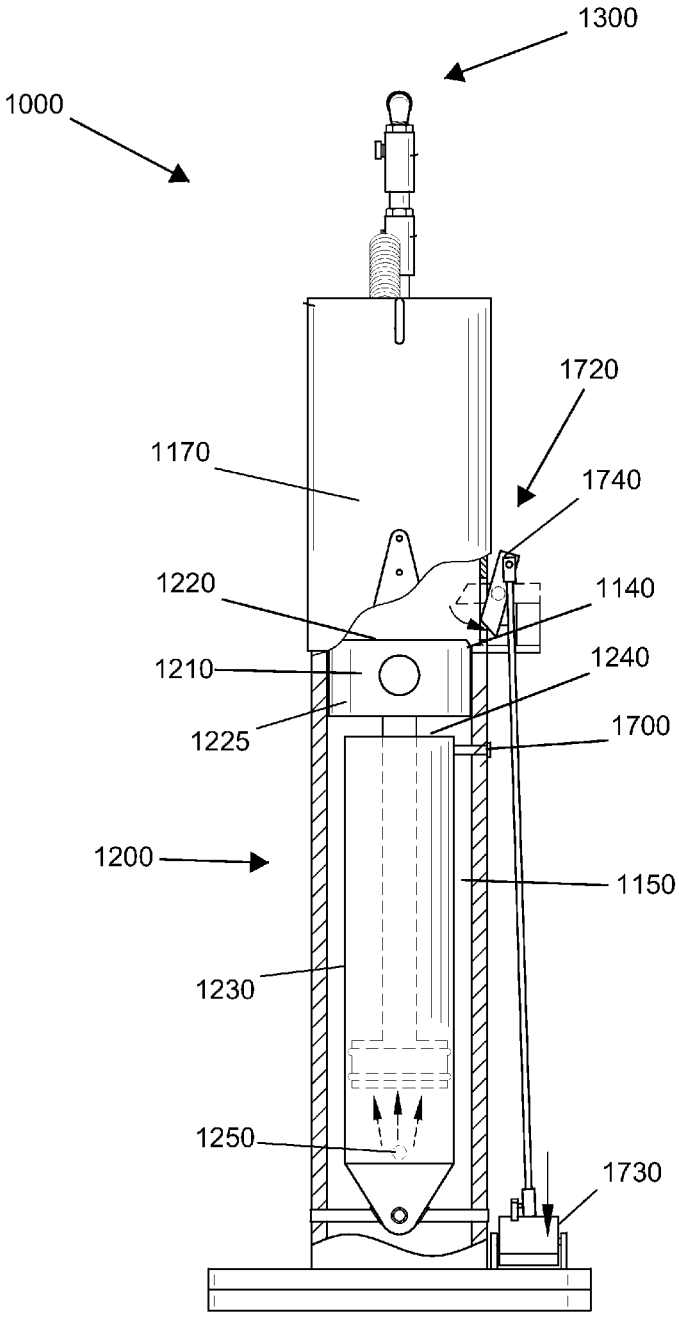
FIG. 8 is a front view of the present invention.
Figure 9:
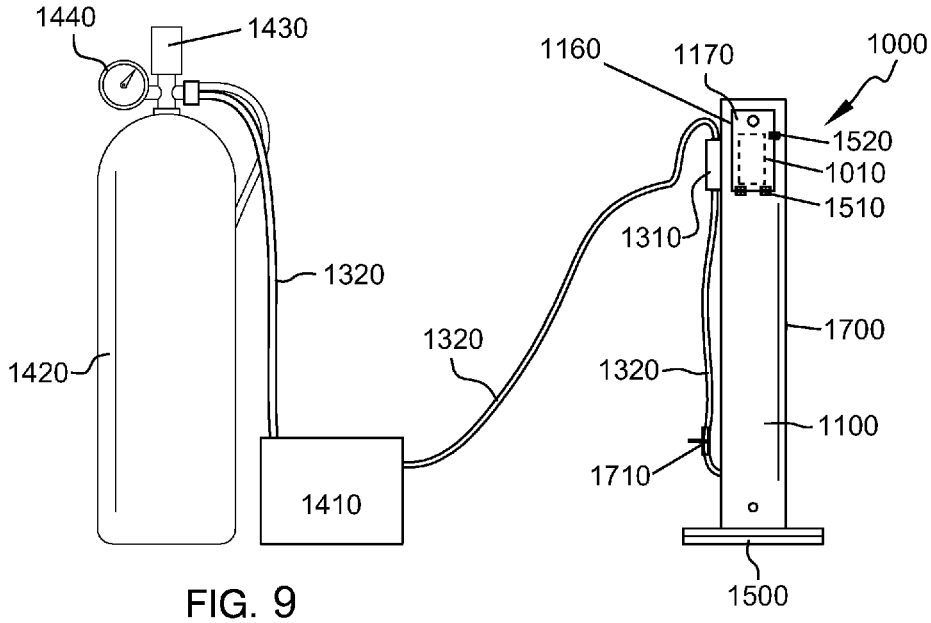
FIG. 9 is a front view of the present invention.
Figure 10:
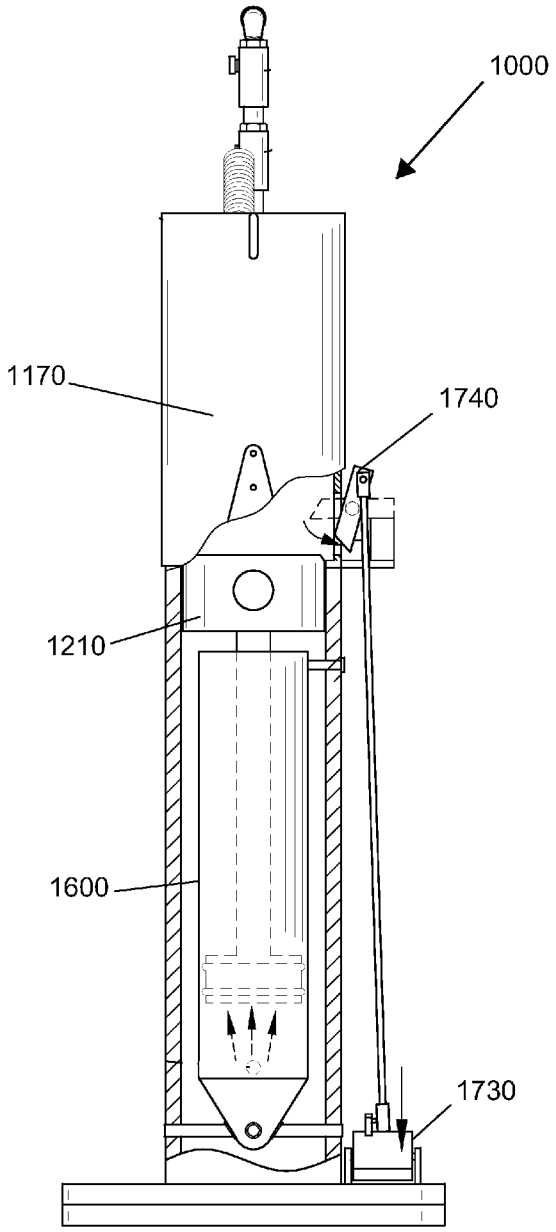
FIG. 10 is a front view of an alternate embodiment of the present invention.
Figure 11:
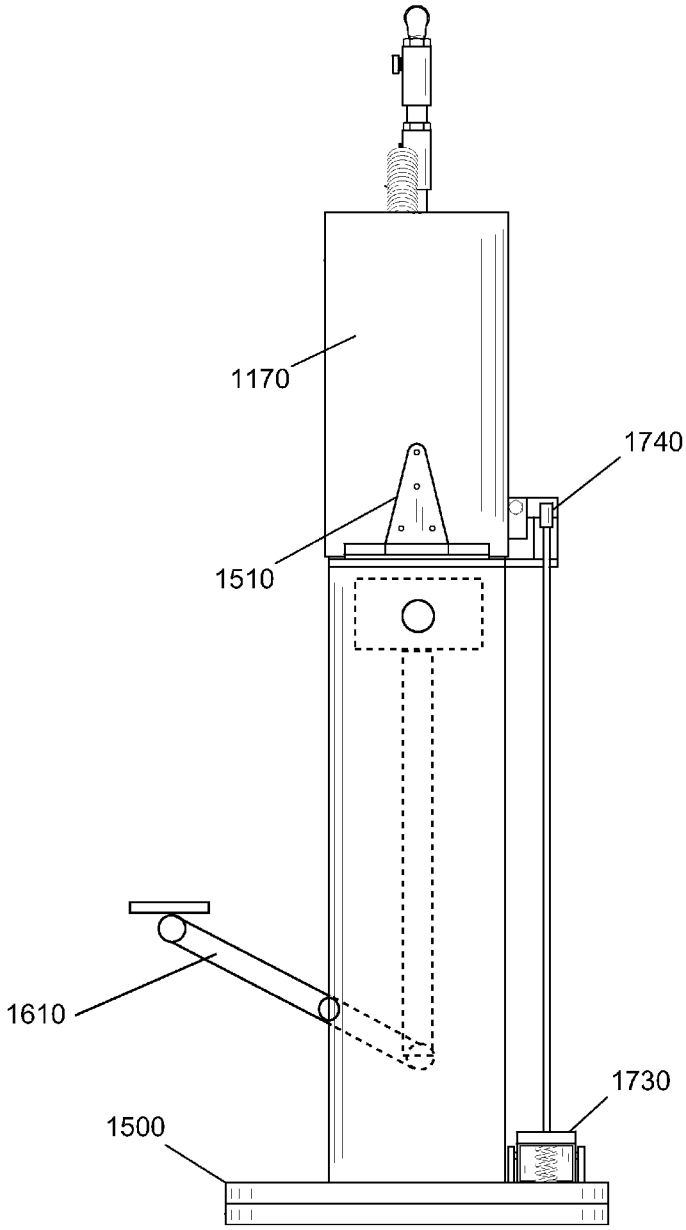
FIG. 11 is a front view of an alternate embodiment of the present invention.

668 Safety valve lever
670 Cover latch
700 Stand
710 Safety interlock
712 Lever
714 Hard stop
750 Rubber pad
820 Air cylinder
830 Rubber seal
880 Inner cavity
900 Air vent
945 Air compressor
950 Air tank
960 Pressure regulator
1000 Pneumatic compacting system
1010 Article of refuse
1100 Housing
1110 Housing top end
1120 Housing side wall
1125 Housing side wall interior surface
1130 Housing bottom end
1140 Housing bottom end aperture
1150 Housing cavity
1160 Access opening
1170 Access door
1200 Compacting assembly
1210 Piston
1220 Piston top surface
1225 Piston outer periphery
1230 Pneumatic ram
1240 Pneumatic ram first end
1250 Pneumatic ram second end
1300 Compressed air control assembly
1310 Valve
1320 Air hose assembly
1400 Compressed air source
1410 Air compressor
1420 Air tank
1430 Regulator
1440 Gauge
1500 Stand
1510 Hinge
1520 Latch
1600 Hydraulic ram
1610 Mechanical lever
1700 Venting orifice
1710 Exhaust valve
1720 Safety interlock
1730 Interlock lever
1740 Interlock hard stop Referring now to FIG. 1-5, the present invention features a pneumatic can crusher (crushing) apparatus (100) for compressing metal cans (150) or plastic bottles (160). The pneumatic can crusher (100) comprises a hollow pipe (200) having an outside surface (210), a top end (220), a bottom end (230), and an inside (250). The top end of the pipe (220) is firmly closed.

The bottom end of the pipe (230) is attached to a stand (700). The stand (700) has a top surface and a bottom surface and helps to keep the pipe (200) in a vertical orientation with respect to the ground surface. A rubber pad (750) may be disposed on the bottom surface of the stand (700), wherein the rubber pad (750) can help to secure the stand (700) to the ground surface. In some embodiments, the rubber pad (750) helps to prevent the stand (700) from slipping on the ground surface.

The pneumatic can crusher apparatus (100) further comprises a piston assembly (270) slidably disposed inside the pipe (250) near the bottom end (230) (e.g., in an inner chamber (880)). The piston assembly (270) comprises a head (280) having a top surface (285) and a bottom surface (286), a connecting rod (290) having a first end (295) and a second end (296), and a bottom air cylinder (820) having a top surface, a bottom surface, and an outer edge. The bottom surface (286) of the head (280) is attached to the first end of the connecting rod (295), and the top surface of the bottom air cylinder (820) is attached to the second end of the connecting rod (296). The bottom air cylinder (820) is housed in the inner chamber (cavity) (880). In some embodiments, seals (830) surround a portion of the piston assembly.

The piston assembly (270) is oriented such that the top surface of the head (285) faces the top end of the pipe (220) and the bottom surface of the bottom air cylinder (820) faces the bottom end of the pipe (230).

An opening (255) is disposed in the pipe (200) near the top end (220). The opening (255) is for allowing a metal can (150) or a plastic bottle (160) to be inserted into the inside of the pipe (250) and placed on the top surface of the head (285) of the piston assembly (270) (see FIG. 4).

A safety door (300) for covering the opening (255) in the pipe (200) is pivotally attached to the pipe (200) via a hinge mechanism (350). The safety door (300) is movable between an open and a closed position respectively allowing and preventing access to the inside of the pipe (250) via the opening (255). In some embodiments, a cover latch (670) is disposed on the outside of the pipe (210) near the safety door (300). The cover latch (670) is for securing the safety door (300) in the closed position. In some embodiments, a handle (320) is disposed on the safety door (300) for assisting a user in moving the safety door (300) to the open position or the closed position.

The can crusher apparatus (100) of the present invention further comprises an air compressor (945) connected to an air tank (950), for example via a third hose (453). The apparatus (100) of the present invention is designed such that air from the air compressor (945) and air tank (950) can be directed to push up against the bottom surface of the bottom air cylinder (820) of the piston assembly, which causes the piston assembly to move upwards toward the top end of the pipe (220). This can crush a metal can (150) or plastic bottle that rests on the top surface (285) of the head (280) (see FIG. 5).

Air from the air compressor (945) is delivered via a first hose (451). In some embodiments, a trip lever (500) is disposed on the first hose (451). The trip lever (500) is movable between an open and a closed position respectively turning on and turning off the air compressor (945). Such trip levers (500) are well known to one of ordinary skill in the art.

Disposed on the second end of the first hose (451) is a safety valve (660). In some embodiments, the safety valve (660) is attached to the pipe (200). In some embodiments, a second hose (452) directs air from the safety valve (660) to below the bottom air cylinder (820) (e.g., into the inner chamber (880)). The safety valve (660) is movable between an open and a closed position respectively allowing and preventing compressed air to be delivered from the air compressor (945) to the piston assembly (270) via the first hose (451), the second hose (452) and the third hose (453). When the safety valve (660) is in the closed position, air from the air compressor (945) cannot cause the piston assembly (270) to move. When the safety valve (660) is in the open position, air from the air compressor (945) can be used to move the piston assembly (270) so as to crush a can (150).

In some embodiments, a spring (665) is attached to the safety door (300) and to the safety valve (660) (e.g., via a linker). The spring (665) keeps the door (300) biased in the open position. The safety valve (660) is controlled via a safety valve lever (668). The safety valve lever (668) requires that the door (300) is shut by the user before the piston (270) can move up.

The safety valve lever (668) causes the safety valve (660) to be pulled to the closed position when the safety door (300) is moved to the open position. The safety valve lever (668) causes the safety valve (660) to be pushed the open position when the safety door (300) is moved to the closed position. This prevents the piston assembly from moving when the safety door (300) is opened so as to prevent an injury.

In some embodiments, moving the safety door (300) to the closed position and turning the trip valve (500) to the open position causes compressed air to move the piston upwards towards the top surface of the pipe (200) to crush the metal can (150) or plastic bottle inside the pipe. In some embodiments, the apparatus (100) of the present invention is designed to crush a can (150) only when the safety door (300) is in the closed position.

In some embodiments, the pneumatic can crushing apparatus (100) comprises a vent (900) for helping to allow pressure (e.g., air) to escape from the air cylinder. In some embodiments, the vent (900) is located in the inside (inner) cavity (880) with the air cylinder (820) for allowing air to enter and exit the inside of the inner cavity (880) when the piston assembly (270) moves.

In some embodiments, the pneumatic can crushing apparatus (100) of the present invention does not comprise a pop-off valve (550). In some embodiments, the pneumatic can crushing apparatus (100) of the present invention further comprises a pop-off valve (550). The pop-off valve (550) can help return to the closed position after the piston assembly (270) has moved upward in the pipe (200) to crush a can (150). For example, the pop-off valve (550) allows air to be exhausted so that the bottom air cylinder (820) can be lowered down to its starting position.

In some embodiments, the pneumatic can crushing apparatus (100) of the present invention further comprises a pressure regulator (960) connected to the air tank (950) and air compressor (945). In some embodiments, the pressure regulator (960) is set to 80 pounds per square inch (psi). In some embodiments, the can crushing apparatus (100) comprises a pressure gauge (650).

In some embodiments, the present invention is used with a standard air compressor (945). Air compressors (945) are well known to those of ordinary skill in the art.

In some embodiments, the apparatus (100) further comprises a manually activated safety interlock (710). In some embodiments, the safety interlock (710) is biased to be engaged. In some embodiments, the safety interlock (710) can be disengaged by a foot of a user. In some embodiments, the safety interlock (710) comprises a lever (712) and a lever-activated hard stop (714) located on the pipe (200). In some embodiments, the hard stop (714) projects into the inside of the pipe (250) providing a barrier between the head of the piston assembly (280) and the top end of the pipe (220). In some embodiments, the safety interlock (710) prevents upward movement of the piston assembly (710) unless disengaged by the user.

In some embodiments, the pneumatic can crushing apparatus (100) has a venting orifice (460) disposed in a second hose fitting (470) on the second hose (452). In some embodiments, the venting orifice (460) provides for an escape of compressed air at a specified rate from the second hose (452) during a cycle of pressurization to facilitate bleed-off for the compressed air in the second hose (452).

In some embodiments, the second hose (452) has an air exhaust valve (480). In some embodiments, the air exhaust valve (480) is manually activated to provide for an escape of compressed air from the second hose (452) during a cycle of pressurization to facilitate bleed-off for the compressed air in the second hose (452).

In some embodiments, the safety valve (660) and/or pop-off valve (550) and/or trip lever (500) is a ½ inch quarter turn valve (e.g., ½ inch pipe fitting, ½ inch inside diameter).

In some embodiments, the bottom air cylinder (820) has a diameter of about 3.25 inches. In some embodiments, the bottom air cylinder (820) has a diameter between about 2 to 4 inches. In some embodiments, the bottom air cylinder (820) has a diameter greater than about 4 inches.

The apparatus (100) of the present invention may be constructed in a variety of sizes. For example, in some embodiments, the pipe (200) is about 48 inches tall as measured from the top edge (220) to the bottom edge (230). In some embodiments, the pipe is between 24 to 36 inches tall as measured from the top edge (220) to the bottom edge (230). In some embodiments, the pipe (200) is between about 36 to 48 inches tall as measured from the top edge (220) to the bottom edge (230). In some embodiments, the pipe (200) is between about 48 to 60 inches tall as measured from the top edge (220) to the bottom edge (230).

In some embodiments, the pipe (200) is about 6 inches in diameter. In some embodiments, the pipe (200) is between about 4 to 6 inches in diameter. In some embodiments, the pipe (200) is between about 6 to 8 inches in diameter. In some embodiments, the pipe (200) is between about 8 to 10 inches in diameter.

In some embodiments, the head (280) of the piston assembly is about 5.75 inches in diameter. In some embodiments, the head (280) of the piston assembly is between about 3 to 5 inches in diameter. In some embodiments, the head (280) of the piston assembly is between about 5 to 10 inches in diameter.

In some embodiments, the stand (700) is circular. In some embodiments, the stand (700) is about 20 inches in diameter. In some embodiments, the stand (700) is between about 10 to 20 inches in diameter. In some embodiments, the stand (700) is between about 20 to 30 inches in diameter.

In some embodiments, the first hose (451), the second hose (452), and the third hose (453) are about 0.5 inches in diameter. In some embodiments, the first hose (451), the second hose (452), and the third hose (453) are between about 0.5 and 1.0 inches in diameter. In some embodiments, the first hose (451), the second hose (452), and the third hose (453) are between about 2.0 to 3.0 inches in diameter.

In some embodiments, a pneumatic compacting system (1000) for reducing a volume occupied by an article of refuse (1010) to facilitate convenient disposal, has a housing (1100). In some embodiments, the housing (1100) has a substantially rigid fully-enclosed housing top end (1110), a housing side wall (1120), a housing bottom end (1130) having a housing bottom end aperture (1140), a housing cavity (1150), and an access opening (1160) having an access door (1170) located on the housing side wall (1120) proximal to the top end (1110). In some embodiments, the access opening (1160) provides access to the housing cavity (1150).

In some embodiments, the system (100) has a compacting assembly (1200) located in the housing (1100) that has a piston (1210) with a piston top surface (1220) and a pneumatic ram (1230). In some embodiments, the piston (1210) is attached to a pneumatic ram first end (1240). In some embodiments, the piston (1210) is located in the housing bottom end aperture (1140). In some embodiments, a piston outer periphery (1225) slidably interfaces with a housing side wall interior surface (1125). In some embodiments, the piston top surface (1220) is a bottom floor surface of the housing cavity (1150), where the piston top surface (1220) faces toward the housing top end (1110). In some embodiments, a pneumatic ram second end (1250) is attached to a fixed point located the housing bottom end (1130).

In some embodiments the system (1000) has a compressed air control assembly (1300) that has a valve (1310) and an air hose assembly (1320). In some embodiments, the valve (1310) is a ball valve. In some embodiments, the valve (1310) is a gate valve. In some embodiments, the valve (1310) is a needle valve.

In some embodiments the system (1000) has a compressed air source (1400). In some embodiments, the air source (1400) is shop air. In some embodiments, the air source (1400) is from an air tank (1420). In some embodiments, the air source (1400) is from an air compressor (1410).

In some embodiments, an article of refuse (1010) is placed through the access opening (1160) into the housing cavity (1150) on top of the piston top surface (1220) for compacting. In some embodiments, upon activation of the valve (1310), compressed air from the compressed air source (1400) displaces the compacting assembly (1200) to a fully extended position. In some embodiments, upon activation of the valve (1310), the piston top surface (1220) approaches the housing top end (1110). In some embodiments, upon activation of the valve (1310), the article of refuse (1010) located in the housing cavity (1150) on top of the piston top surface (1220) is compacted. In some embodiments, upon deactivation of the valve (1310), the compacting assembly (1200) retracts to a rest position.

In some embodiments, the travel distance of the compacting assembly (1200) is adjustable. In some embodiments, when the compacting assembly (1200) is in a fully extended position, the distance between the top of the piston top surface (1220) and the housing top end (1110) can be altered by replacing the piston (1210) with a piston (1210) of a different size. In some embodiments, when the compacting assembly (1200) is in a fully extended position, the distance between the top of the piston top surface (1220) and the housing top end (1110) can be altered by replacing the pneumatic ram (1230) with a pneumatic ram (1230) of a different size.

In some embodiments, the housing (1100) is cylindrical, having a round cross-section. In some embodiments the housing (1100) is cubical, having a rectangular cross-section.

In some embodiments the system (1000) has a stand (1500). In some embodiments, the stand (1500) is removable from the housing (1100). In some embodiments, the stand (1500) is not removable from the housing (1100). In some embodiments, the stand has a flange for mounting to the floor or a bench. In some embodiments, the stand (1500) has feet for mounting to the floor or a bench.

In some embodiments, the access door (1170) has a hinge (1510), and a latch (1520). In some embodiments the access door (1170) has a safety interlock connected to the compressed air control assembly (1300) to prevent operation of the system unless the access door (1170) is fully closed and latched.

In some embodiments, the compressed air source (1400) has an air compressor (1410), an air tank (1420), an air regulator, and an air gauge (1440).

In some embodiments, a hydraulic ram (1600) is used to displace the compacting assembly (1200). In some embodiments, the hydraulic ram (1600) can be substituted for the pneumatic ram (1230).

In some embodiments, a mechanical lever (1610) is used to displace the compacting assembly (1200). In some embodiments, the mechanical lever (1610) can be substituted for the pneumatic ram (1230).

In some embodiments, the compressed air control assembly (1300) has a venting orifice (1700). In some embodiments, the venting orifice (1700) provides for an escape of compressed air at a specified rate from the compressed air control assembly (1300) during a cycle of pressurization to facilitate bleed-off for the compressed air in the system (1000). In some embodiments, the venting orifice (1700) is about 0.030" in diameter. In some embodiments, the venting orifice (1700) is about 0.060" in diameter. In some embodiments, the venting orifice (1700) is about 0.090" in diameter. In some embodiments, the venting orifice (1700) is about 0.120" in diameter. In some embodiments, the venting orifice (1700) is about 0.150" in diameter. In some embodiments, the venting orifice (1700) is about 0.180" in diameter. In some embodiments, the venting orifice (1700) is located on the air hose assembly (1320).

In some embodiments, the compressed air control assembly (1300) has an air exhaust valve (1710). In some embodiments, the air exhaust valve (1710) is manually activated to provide for an escape of compressed air from the compressed air control assembly (1300) during a cycle of pressurization to facilitate bleed-off for the compressed air in the system (1000). In some embodiments, the air exhaust valve (1710) is located on the air hose assembly (1320).

In some embodiments, the system (1000) further has a manually-activated safety interlock (1720). In some embodiments, the safety interlock (1720) is biased to be engaged. In some embodiments, the safety interlock (1720) can be disengaged by a foot of a user. In some embodiments, the safety interlock (1720) has an interlock lever (1730) and a lever-activated interlock hard stop (1740) located on the housing side wall (1120). In some embodiments, the interlock hard stop (1740) projects into the interior of the housing cavity (1150) providing a barrier between the piston top surface (1220) and the housing top end (1110). In some embodiments, the safety interlock (1720) prevents upward movement of the compacting assembly (1200) unless disengaged by the user.

As used herein, the term "about" refers to plus or minus 10% of the referenced number. For example, an embodiment wherein the pipe (200) or housing (1100) is about 48 inches tall includes an apparatus that is between 42 and 54 inches in length.

The disclosures of the following U.S. Patents are incorporated in their entirety by reference herein: U.S. Pat. No. 5,303,643; U.S. Pat. No. 3,104,607; U.S. Pat. No. 5,257,576; U.S. Pat. No. 5,060,564; U.S. Pat. No. 5,109,763; U.S. Pat. No. 5,624,018; U.S. Pat. No. 5,279,215; U.S. Pat. No. 2,916,985; U.S. Pat. No. 5,174,199; U.S. Pat. No. 2,817,290.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

The reference numbers recited in the below claims are solely for ease of examination of this patent application, and are exemplary, and are not intended in any way to limit the scope of the claims to the particular features having the corresponding reference numbers in the drawings.

What is claimed is:

1. A pneumatic can crusher (100) for compressing a metal can (150) or a plastic bottle (160), said pneumatic can crusher (100) comprising:

(a) a hollow pipe (200) having a top end (220), a bottom end (230), an outside (210), and an inside (250); wherein the top end of the pipe (220) is closed and the bottom end (230) is attached to a stand (700);

(b) a piston assembly (270) disposed inside the pipe (250) near the bottom end (230), said piston assembly (270) comprising a head (280) attached to a first end of a connecting rod (295) and a bottom air cylinder (820) connected to a second end of a connecting rod (296); wherein the piston assembly (270) is oriented such that the head (280) faces the top end of the pipe (220) and the bottom air cylinder (820) faces the bottom end of the pipe (230); wherein the bottom air cylinder (820) is inside an inner cavity (880);

(c) an opening (255) disposed in the pipe (200) near the top end (220), wherein the opening (255) is for allowing the metal can (150) to be inserted into the inside (250) of the pipe (200) and placed on a top surface of the head (285) of the piston assembly (270);

(d) a safety door (300) for covering the opening (255) in the pipe (200) pivotally attached to the pipe (200) via a hinge mechanism (350), wherein the safety door (300) is movable between an open and a closed position respectively allowing and preventing access to the inside of the pipe (250) via the opening (255); and (e) an air compressor (945) connected to an air tank (950), wherein air from the air compressor (945) is directed to a safety valve (660) via a first hose (451), wherein the safety valve (660) is movable between an open and a closed position respectively allowing and preventing compressed air to be delivered from the air compressor (945) to the piston assembly (270) via a second hose (452); and (f) a manually activated safety interlock (710), wherein said safety interlock (710) is biased to be engaged and can be disengaged by a foot of a user, wherein said safety interlock (710) comprises a lever (712) and a lever-activated hard stop (714) disposed on the pipe (200), wherein said hard stop (714) projects into the inside of the pipe (250) providing a barrier between the head of the piston assembly (280) and the top end of the pipe (220), wherein said safety interlock (710) prevents upward movement of the piston assembly (710) unless disengaged by the user;

wherein air from the air compressor (945) pushes the air cylinder (820) upward toward the top end of the pipe (220) so to crush the metal can (150) on the top surface of the head (285) of the piston assembly (270).

2. The pneumatic can crushing apparatus (100) of claim 1 further comprising a rubber pad (750) disposed on a bottom surface of the stand (700) for helping to prevent the stand (700) from slipping on a ground surface.

3. The pneumatic can crushing apparatus (100) of claim 1, wherein a trip lever (500) is connected to the first hose (451) that can move between open and a closed position respectively allowing or preventing air travelling from the air compressor (945) to the safety valve (660).

4. The pneumatic can crushing apparatus (100) of claim 1 further comprising a cover latch (670) disposed on the outside (210) of the pipe (200) near the safety door (300) for securing the safety door (300) in the closed position.

5. The pneumatic can crushing apparatus (100) of claim 1 further comprising a handle (320) disposed on the safety door (300).

6. The pneumatic can crushing apparatus (100) of claim 1, wherein a vent (900) is disposed in the inside cavity (880) with the air cylinder (820) for allowing air to enter and exit the inside of the inner cavity (880) with the air cylinder (820) when the piston assembly (270) moves.

7. The pneumatic can crushing apparatus (100) of claim 1 further comprising a spring (665) connecting the safety door (300) to the safety valve (660), wherein the spring (665) causes the door (300) to be biased in the open position.

8. The pneumatic can crushing apparatus (100) of claim 1, further comprising a venting orifice (460), said venting orifice (460) is disposed in a second hose fitting (470) on the second hose (452), wherein said venting orifice (460) provides for an escape of compressed air at a specified rate from the second hose (452) during a cycle of pressurization to facilitate bleed-off for the compressed air in the second hose (452).

9. The pneumatic can crushing apparatus (100) of claim 1, wherein the second hose (452) further comprises a air exhaust valve (480), wherein the air exhaust valve (480) is manually activated to provide for an escape of compressed air from the second hose (452) during a cycle of pressurization to facilitate bleed-off for the compressed air in the second hose (452).

10. A pneumatic compacting system (1000) for reducing a volume occupied by an article of refuse (1010) to facilitate convenient disposal, said system (1000) comprising:

(a) a housing (1100), comprising a substantially rigid fully-enclosed housing top end (1110), a housing side wall (1120), a housing bottom end (1130) having a housing bottom end aperture (1140), a housing cavity (1150), and an access opening (1160) having an access door (1170) disposed on the housing side wall (1120) proximal to the top end (1110);

(b) a compacting assembly (1200) disposed in the housing (1100) comprising a piston (1210) having a piston top surface (1220) and a pneumatic ram (1230), wherein the piston (1210) is attached to a pneumatic ram first end (1240), wherein the piston (1210) is disposed in the housing bottom end aperture (1140), wherein a piston outer periphery (1225) slidably interfaces with a housing side wall interior surface (1125), wherein the piston top surface (1220) is a bottom floor surface of the housing cavity (1150), wherein the piston top surface (1220) faces toward the housing top end (1110), wherein a pneumatic ram second end (1250) is attached to a fixed point disposed the housing bottom end (1130);

(c) a compressed air control assembly (1300) comprising a valve (1310) and an air hose assembly (1320); and (d) a compressed air source (1400);

wherein an article of refuse (1010) is placed through the access opening (1160) into the housing cavity (1150) on top of the piston top surface (1220) for compacting, wherein upon activation of the valve (1310), compressed air from the compressed air source (1400) displaces the compacting assembly (1200) to a fully extended position, wherein, upon activation of the valve (1310), the piston top surface (1220) approaches the housing top end (1110), wherein upon activation of the valve (1310), the article of refuse (1010) disposed in the housing cavity (1150) on top of the piston top surface (1220)

is compacted, wherein upon deactivation of the valve (1310), the compacting assembly (1200) retracts to a rest position.

11. The system (1000) of claim 10, wherein the housing (1100) is cylindrical, having a round cross-section.

12. The system (1000) of claim 10, wherein the system (1000) comprises a stand (1500).

13. The system (1000) of claim 10, wherein the access door (1170) comprises a hinge (1510), and a latch (1520).

14. The system (1000) of claim 10, wherein the compressed air source (1400) comprises an air compressor (1410), an air tank (1420), an air regulator, and an air gauge (1440).

15. The system (1000) of claim 10, wherein the compressed air control assembly (1300) further comprises a venting orifice (1700), wherein said venting orifice (1700) provides for an escape of compressed air at a specified rate from the compressed air control assembly (1300) during a cycle of pressurization to facilitate bleed-off for the compressed air in the system (1000).

16. The system (1000) of claim 10, wherein the compressed air control assembly (1300) further comprises an air exhaust valve (1710), wherein the air exhaust valve (1710) is manually activated to provide for an escape of compressed air from the compressed air control assembly (1300) during a cycle of pressurization to facilitate bleed-off for the compressed air in the system (1000).

17. A pneumatic compacting system (1000) for reducing a volume occupied by an article of refuse (1010) to facilitate convenient disposal, said system (1000) comprising:

(a) a housing (1100), comprising a substantially rigid fully-enclosed housing top end (1110), a housing side wall (1120), a housing bottom end (1130) having a housing bottom end aperture (1140), a housing cavity (1150), and an access opening (1160) having an access door (1170) disposed on the housing side wall (1120) proximal to the top end (1110);

(b) a compacting assembly (1200) disposed in the housing (1100) comprising a piston (1210) having a piston top surface (1220) and a pneumatic ram (1230), wherein the piston (1210) is attached to a pneumatic ram first end (1240), wherein the piston (1210) is disposed in the housing bottom end aperture (1140), wherein a piston outer periphery (1225) slidably interfaces with a housing side wall interior surface (1125), wherein the piston top surface (1220) is a bottom floor surface of the housing cavity (1150), wherein the piston top surface (1220) faces toward the housing top end (1110), wherein a pneumatic ram second end (1250) is attached to a fixed point disposed the housing bottom end (1130);

(c) a compressed air control assembly (1300) comprising a valve (1310) and an air hose assembly (1320);

(d) a compressed air source (1400); and (e) a manually-activated safety interlock (1720), wherein said safety interlock (1720) is biased to be engaged, wherein said safety interlock (1720) can be disengaged by a foot of a user, wherein said safety interlock (1720) comprises an interlock lever (1730) and a lever-activated interlock hard stop (1740) disposed on the housing side wall (1120), wherein said interlock hard stop (1740) projects into the interior of the housing cavity (1150) providing a barrier between the piston top surface (1220) and the housing top end (1110), wherein said safety interlock (1720) prevents upward movement of the compacting assembly (1200) unless disengaged by the user;

wherein an article of refuse (1010) is placed through the access opening (1160) into the housing cavity (1150) on top of the piston top surface (1220) for compacting, wherein upon activation of the valve (1310), compressed air from the compressed air source (1400) displaces the compacting assembly (1200) to a fully extended position, wherein, upon activation of the valve (1310), the piston top surface (1220) approaches the housing top end (1110), wherein upon activation of the valve (1310), the article of refuse (1010) disposed in the housing cavity (1150) on top of the piston top surface (1220) is compacted, wherein upon deactivation of the valve (1310), the compacting assembly (1200) retracts to a rest position.

* * * * *